US006506085B1

(12) United States Patent
Casey et al.

(10) Patent No.: US 6,506,085 B1
(45) Date of Patent: Jan. 14, 2003

(54) PUMP AND DRAIN APPARATUS FOR A MARINE PROPULSION SYSTEM

(75) Inventors: Thomas P. Casey, Stillwater, OK (US); Matthew W. Jaeger, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 21 days.

(21) Appl. No.: 09/887,823

(22) Filed: Jun. 22, 2001

(51) Int. Cl.[7] ..... B63H 23/34
(52) U.S. Cl. ..... 440/88; 114/183
(58) Field of Search ..... 440/88; 114/183

(56) References Cited

U.S. PATENT DOCUMENTS

| | | | | |
|---|---|---|---|---|
| 4,693,690 A | | 9/1987 | Henderson | 440/88 |
| 4,741,715 A | | 5/1988 | Hedge | 440/88 |
| 4,776,820 A | | 10/1988 | Mapes | 440/88 |
| 4,789,367 A | | 12/1988 | Fulks | 440/88 |
| 5,123,369 A | | 6/1992 | Gross | 114/183 |
| 5,334,063 A | | 8/1994 | Inoue et al. | 440/88 |
| 5,632,220 A | * | 5/1997 | Vento | 114/255 |
| 5,660,536 A | | 8/1997 | Karls et al. | 418/15 |
| 5,980,342 A | | 11/1999 | Logan et al. | 440/88 |
| 6,089,934 A | | 7/2000 | Biggs et al. | 440/88 |
| 6,135,064 A | | 10/2000 | Logan et al. | 123/41 |

* cited by examiner

*Primary Examiner*—Jesus D. Sotelo
(74) *Attorney, Agent, or Firm*—William D. Lanyi

(57) ABSTRACT

An integral pump and drain apparatus is contained in a common housing structure to reduce the required space needed for these components in the vicinity proximate the engine of a marine propulsion system. The valve of the drain is remotely actuated by air pressure and therefore does not require the boat operator to manually remove plugs or manually actuate mechanical components to cause the engine to drain through a drain conduit that is formed as an integral part of the housing structure.

18 Claims, 5 Drawing Sheets

PUMP AND DRAIN APPARATUS FOR A MARINE PROPULSION SYSTEM

BACKGROUND OF THE INVENTION

1. Field of the Invention

The present invention is generally related to a pump and drain apparatus for a marine vessel and, more particularly, to an integral structure wherein the pump and drain assembly is contained within a single housing structure.

2. Description of the Prior Art

Many different mechanisms have been devised for draining and flushing cooling systems for marine propulsion devices. These draining systems typically comprise a method for opening one or more ports in the engine cooling system to allow cooling water to flow out of the cooling system and either into the bilge of a marine vessel or overboard. The draining operation is typically performed by a boat owner on a periodic basis to remove cooling water from the engine when the boat is not in use and, most particularly, when temperatures are expected to fall below the freezing point. Failure to drain water from the marine propulsion cooling system could result in severe damage if the entrapped water freezes.

U.S. Pat. No. 4,741,715, which issued to Hedge on May 3, 1988, discloses a pressure actuated drain valve for automatically draining the cooling water from a marine drive engine when the engine is stopped. The drain valve includes a spring-loaded diaphragm which moves to a closed position when the engine water pump is operating to close an outlet from the engine cavities to be drained. The diaphragm automatically moves to its open position when the engine water pump is off to open the outlet to allow cooling water to drain from the engine cavities.

U.S. Pat. No. 4,693,690, which issued to Henderson on Sep. 15, 1987, describes a quick drain assembly for a boat engine. The drain device for an inboard boat engine, especially an engine of the type having a water jacket to which a plurality of drain cocks are connected through which the engine coolant must be drained after each use of the engine is disclosed. The quick drain device is in the form of a barrel having a plurality of lateral tubes radiating therefrom. An expandable stopper is received within the barrel and covers the ends of the tubes and thereby prevents flow therethrough. The other ends of the lateral tubes are connected to the drain cocks or drain plugs located on the engine block. Removal of the expandable stopper simultaneously drains all of the drain plugs.

U.S. Pat. No. 6,089,934, which issued to Biggs et al on Jul. 18, 2000, discloses an engine cooling system with a simplified drain and flushing procedure. An engine cooling system is provided with one or more flexible conduits attached to drain openings of the engine and its related components. First ends of the conduits are attached to the drain openings while the second ends are sealed by studs attached to a plate of a stationary bracket. A retainer is slidably associated with the flexible conduits and attached to a tether which is, in turn, attached to a handle. By manipulating the handle, the tether forces the retainer to slide along the flexible conduits and control the position of second ends of the flexible conduits. This allows the system to be moved from a first position with the second ends of the conduits above the first ends of the conduits to a second position with the second ends of the conduits below the first ends and in the bilge of the boat. The system allows an operator to stand in a single location and move the drain system from the first and second positions and back again without having to reach down into the engine compartment to remove drain plugs. The system allows the cooling system to be easily drained for flushed.

U.S. Pat. 5,123,369, which issued to Gross on Jun. 23, 1992, describes a marine valve structure. A valve apparatus for a marine vessel has a housing with first, second, and third ports and a valve member within the housing. The housing is mounted to the hull of the vessel with the first port communicating with the body of water outside of the vessel. The third port is connected to the cooling system of an engine in the vessel and the second is closed by a quick release plug. The valve member is movable to open and close communication with the outside. During the normal operation, water is drawn through the structure into the engine cooling system and is discharged overboard. In an emergency, the plug can be removed and the valve member moved to a 90° position in which the communication with the outside is closed, allowing the engine to draw water from within the hull and discharge it overboard. The structure can also be used with a service adapter for engine flushing and other maintenance.

U.S. Pat. No. 6,135,064, which issued to Logan et al on Oct. 24, 2000, discloses an engine drain system. An engine cooling system is provided with a manifold that is located below the lowest point of the cooling system of an engine. The manifold is connected to the cooling system of the engine, a water pump, a circulation pump, the exhaust manifolds of the engine, and a drain conduit through which all of the water can be drained from the engine.

U.S. Pat. No. 5,980,342, which issued to Logan et al on Nov. 9, 1999, discloses a flushing system for a marine propulsion engine. A flushing system provides a pair of check valves that are used in combination with each other. One of the check valve is attached to a hose located between the circulating pump and the thermostat housing of the engine. The other check valve is attached to a hose through which fresh water is provided. Both check valves prevent flow of water through them unless they are associated together in locking attachment. The check valve attached to the circulating pump hose of the engine directs a stream of water from the hose toward the circulating pump so that the water can then flow through the circulating pump, the engine block, the heads, the intake manifold, and the exhaust system of the engine to remove sea water residue from the internal passages and surfaces of the engine. It is not required that the engine be operated during the flushing operation.

U.S. Pat. No. 5,334,063, which issued to Inoue et al on Aug. 2, 1994, describes a cooling system for a marine propulsion engine. A number of embodiments of cooling systems for marine propulsion units having water cooled internal combustion engines in which the cooling jacket of the engine is at least partially positioned below the level of the water in which the watercraft is operating are described. The described embodiments all permit draining of the engine cooling jacket when it is not being run. In some embodiments, the drain valve also controls the communication of the coolant from the body of water in which the watercraft is operating with the engine cooling jacket. Various types of pumping arrangements are disclosed for pumping the bilge and automatic valve operation is also disclosed.

U.S. Pat. No. 4,789,367, which issued to Fulks on Dec. 6, 1988, describes a marine engine flushing and emergency bilge pumping assembly. An assembly for a boat having an internal combustion engine which uses sea water as its coolant and a bilge which collects sea water is disclosed. The assembly comprises a Y-shaped pipe whose tail is connected to the water pump of the internal combustion engine, a first manually operable on-off valve for controlling the flow of sea water into the water pump located in one arm of the Y-shaped pipe, a second manually operable on-off valve for controlling the flow of an alternative source of water into the water pump located in the second arm of the Y-shaped pipe, and a length of flexible hose attached to the end of the second arm of the Y-shaped pipe, the free end of said hose being alternatively connectable to a source of fresh water or to the sea water in the bilge. The assembly may include a switch mounted on the Y-shaped pipe whenever the on-off valve between the engine's water pump and the hose leading to the sea is closed. This switch controls a red warning light mounted on the boat's console to give a visual warning to the boat operator that the connection between the sea water and the engine's water pump, which is normally open, is closed.

U.S. Pat. No. 4,776,820, which issued to Mapes on Oct. 11, 1988, discloses a bilge water pump mechanism for outboard motor cowl. A pump mechanism continuously operable by the engine of an outboard motor for discharging water that collects by seepage or leakage into the engine cowl. The pump mechanism includes an inlet conduit having an inlet end positioned closely adjacent to the bottom of an inclined channel formed in the lower section of the engine cowl, and an outlet conduit having an outlet end positioned exteriorly of the cowl. A filter disposed in the inlet conduit removes debris from the water and protects the pump mechanism, and a bracket mounted to the engine block holds the inlet end of the inlet conduit closely adjacent to the bottom of the channel.

U.S. Pat. No. 5,660,536, which issued to Karls et al on Aug. 26, 1997, discloses a high capacity simplified sea water pump. A sea water pump for a marine propulsion system includes a housing having a generally cylindrical pumping chamber defined by a generally cylindrical sidewall extending axially between opposite end walls. A multi-vaned rotary impeller in the chamber is driven by an impeller shaft extending axially into the chamber through one of the endwalls. An intake port at the other endwall has a first branch providing radial flow into the chamber, and a second branch providing axial flow into the chamber. A discharge port has a first branch receiving radial flow out of the chamber, and a second branch receiving axial flow out of the chamber. The housing is an integrally molded one-piece cup-shaped unit including the cylindrical sidewall integral with an end cap providing a flat inner wall wear surface providing the noted endwall engaging an axial end of the impeller in sealing sliding relation.

U.S. patent application Ser. No. 09/643,612 (M09459), which was filed on Aug. 22, 2000, by Biggs et al and assigned to the assignee of the present application discloses a pneumatically actuated marine engine water draining system. The drain system for a marine vessel is provided which includes one or more pressure actuated valves associated with the coolant water drain system. The boat operator is provided with a pressure controller that allows pressure to be introduced into the system for the purpose of actuating the drain valves and, as a result, opening various drain conduits to allow cooling water to drain from the engine cooling system into the bilge or overboard.

The patents described above are hereby expressly incorporated by reference in the description of the present invention.

All types of marine engines require some type of device which causes water to be drawn from the body of water in which the boat is operated and pumped through the cooling passages of the engine. This water is then discharged overboard, sometimes with combination with the exhaust gases emanating from the engine. This function is often produced by a pump which comprises an impeller that is rotated within a chamber to pump the water from the body of water and through the cooling passages of the engine. Marine engines also require a means for allowing entrapped cooling water in the cooling passages of the engine to be drained from the engine. The method for draining a marine engine can comprise the mere removal of one or more plugs to allow water to drain from the engine into the bilge of the boat. The drain system can also incorporate means by which this procedure can be accomplished without requiring the operator to reach down into the engine compartment to remove the plugs. Some methods of this type are disclosed in the patents described above.

Both the water pump and the engine drain system require space in the vicinity adjacent to the engine. In addition, the water pump and the drain mechanism are often connected to each other by hoses which also require space in the vicinity adjacent to the engine. It would therefore by significantly beneficial if the functions of the water pump and the drain system could be combined in a compact integral structure that efficiently accomplishes the function of pumping water from the body of water to the cooling passages of the engine and also accomplishes the function of draining water from the cooling passages of the engine and its associated conduits.

SUMMARY OF THE INVENTION

An integral pump and drain apparatus for a marine propulsion system made in accordance with the preferred embodiment of the present invention comprises a housing structure and a pumping member disposed within a cavity of the housing structure. It further comprises an inlet conduit formed within the housing structure and connected in fluid communication with the cavity. Also, it comprises an outlet conduit formed within the housing structure and connected in fluid communication with the cavity. Actuation of the pumping member causes water to flow toward the cavity through the inlet conduit and away from the cavity through the outlet conduit. The water flowing away from the cavity through the outlet conduit is directed into the cooling passages of an engine.

The present invention further comprises a drain conduit formed within the housing structure and connectable in fluid communication with at least one of the inlet and outlet conduits. A particularly preferred embodiment provides connection between the drain conduit and both the inlet and outlet conduits. A valve is associated with the drain conduit for selectively opening or closing the drain conduit to drain water from the inlet and outlet conduits.

In a particularly preferred embodiment of the present invention, the pumping member comprises a flexible rubber impeller which is rotatable within the cavity for rotation about an axis for causing water to flow toward the cavity through the inlet conduit and away from the cavity through the outlet conduit. The housing structure comprises a first portion and a second portion, which are attachable to each other with a plurality of bolts or screws. The cavity is formed within the first portion and the drain conduit is formed within the second portion. The valve can be a pneumatically operated valve having a spool member which is movable within a portion of the drain conduit. Although a pneumatically operated valve is not required in all embodiments of the present invention, a preferred embodiment of the present invention is particularly designed to work in cooperation with pneumatically operated valves similar to those described in the pneumatically actuated marine engine water drain system which is a subject of the patent application described above.

The spool member can be movable to an opened position which connects the inlet and/or outlet conduits in fluid communication with the drain conduit in order to allow water to drain from the inlet and/or outlet conduits through the drain conduit. A shaft can extend from the housing structure and be attached to the pumping member in order to allow the impeller of the pumping member to be rotated through being connected in torque transmitting relation with another component of the marine propulsion system. This connection can be a belt driven arrangement, a gear driven connection, or a spline connection to any rotating shaft of the marine propulsion system.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
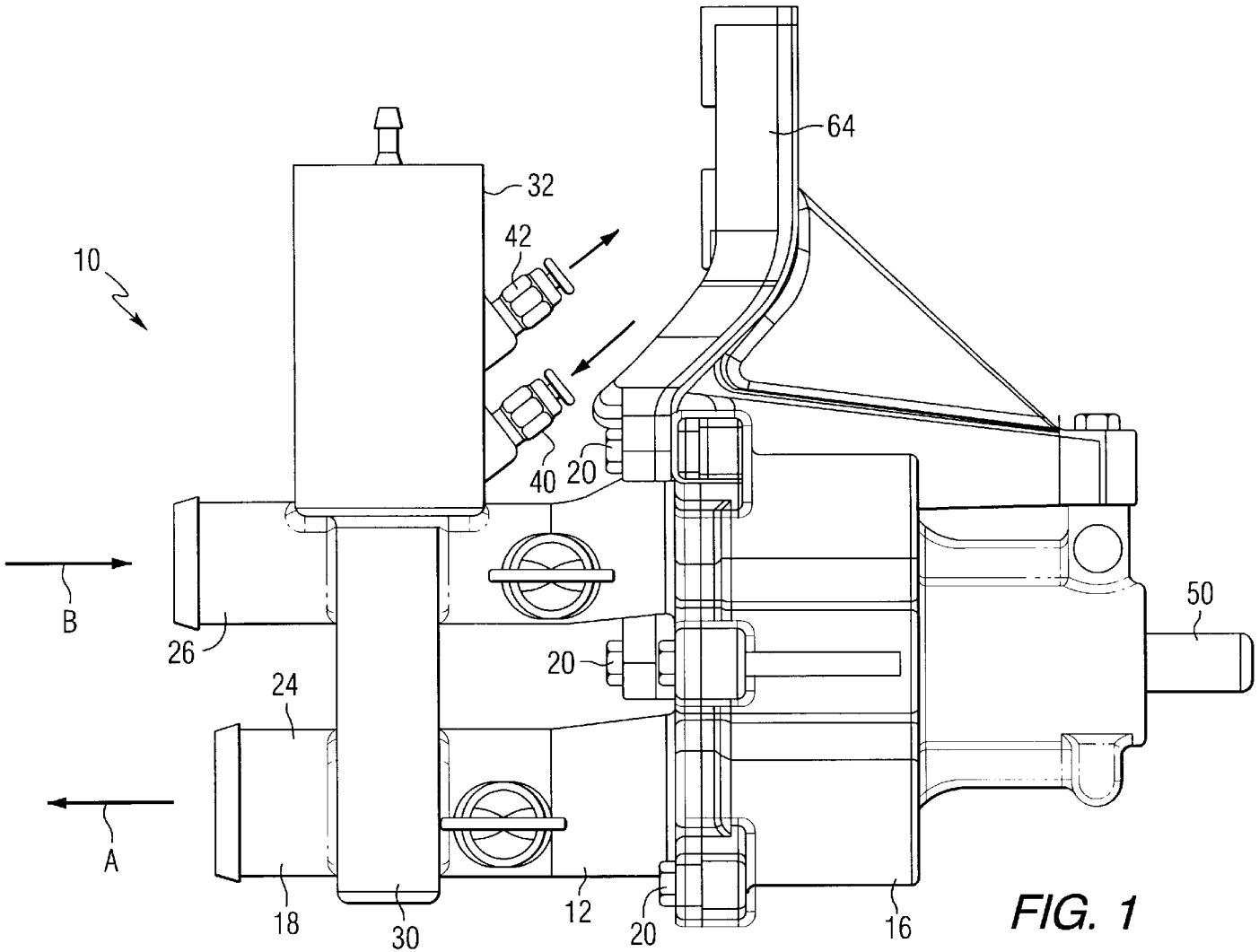
FIG. 1 is a side view of the present invention.

Throughout the description of the preferred embodiment of the present invention, like components will be identified by like reference numerals.

The integral pump and drain apparatus 10 shown in FIG. 1 comprises a housing structure 12 that, in turn, comprises a first portion 16 and a second portion 18. The first and second portions, 16 and 18, are attachable to each other by a plurality of threaded components 20 which can be bolts or screws.

An outlet conduit 24 conducts water from a pumping member contained within the first portion 16 to the cooling passages of an engine, as represented by arrow A. Water is drawn from a body of water in which the marine vessel is operating, as represented by arrow B, in a direction toward the impeller of the pumping member which is disposed in a cavity formed within the first portion 16 of the housing structure 12. A drain conduit 30 is formed within the housing structure 12 and is connectable in fluid communication with at least one of the inlet and outlet conduits, 26 and 24, respectively. As will be described in greater detail below, a valve is disposed within the drain conduit 30 and is movable for selectively opening or closing the drain conduit 30 to drain water from the inlet and/or outlet conduits, 26 and 24. Movement of the valve is controlled by a pneumatically actuated portion of the valve contained within compartment 32. Pressurized air is conducted into the compartment 32 to cause the piston portion of the valve to move the spool in an upward direction within the drain conduit 30. This pressurized air enters port 40 and moves the piston upward against the resistance of a spring contained within compartment 32. Port 42 is connected in fluid communication with a pressure indicator associated with an air manifold (not shown in FIG. 1) to allow the operator of a marine vessel to recognize when the valve is pressurized to allow water to drain from at least one of the inlet 26 and outlet 24 conduits.

With continued reference to FIG. 1, a shaft 50 extends from the housing structure 12 and is connected to an impeller of the pumping member contained within the first portion 16 of the housing structure. Rotation of the shaft 50 causes the impeller to rotate and draw water into the inlet conduit 26 from the body of water in which the boat operates and pump the water out of the outlet conduit 24 to the cooling system of the engine.

Figure 2:
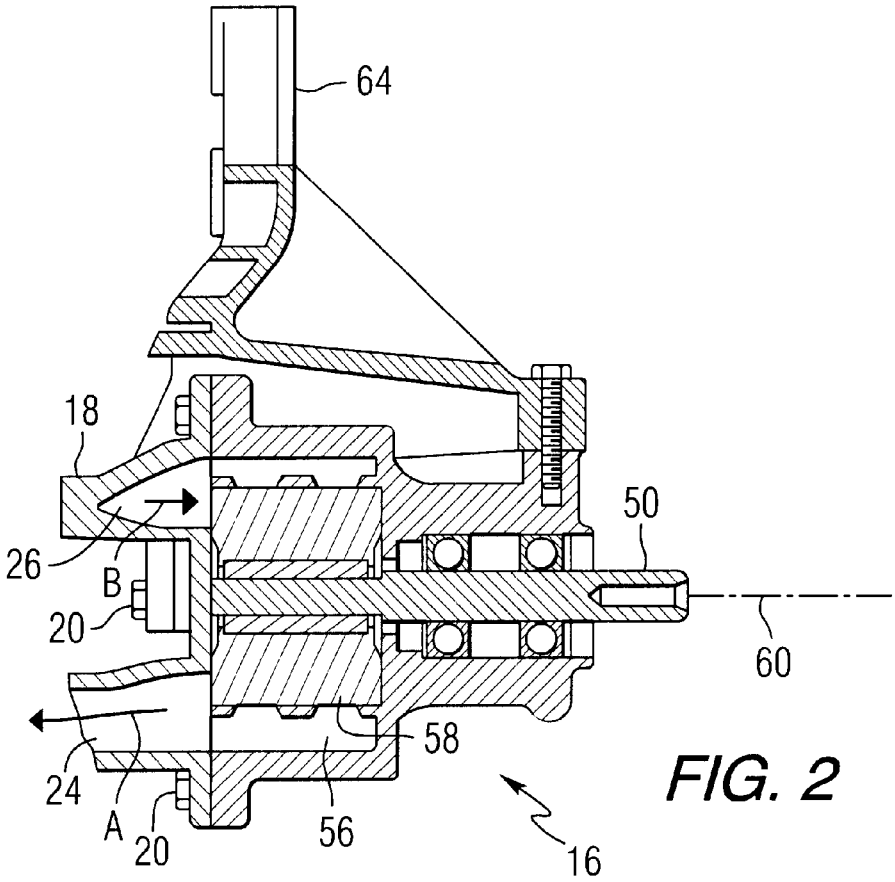
FIGS. 2 and 3 are views of the first and second portion of the housing structure of the present invention.

FIG. 2 is a section view of the first portion 16 of the housing structure 12. It also shows a partial section view of the second portion 18. Within the first portion 16 of the housing structure, a cavity 56 is formed and shaped to receive an impeller 58 for rotation about axis 60. Rotation of the impeller 58 about axis 60 causes water to be drawn, as represented by arrow B, into the cavity 56 and pumped out through the outlet conduit 24 as represented by arrow A. Shaft 50 is supported by bearings, as shown in FIG. 2 for rotation about axis 60 to drive the pumping member. In FIGS. 1 and 2, a bracket 64 is attached to the housing structure to allow the integral pump and drain apparatus 10 to be attached to a support member, such as the engine.

Figure 3:
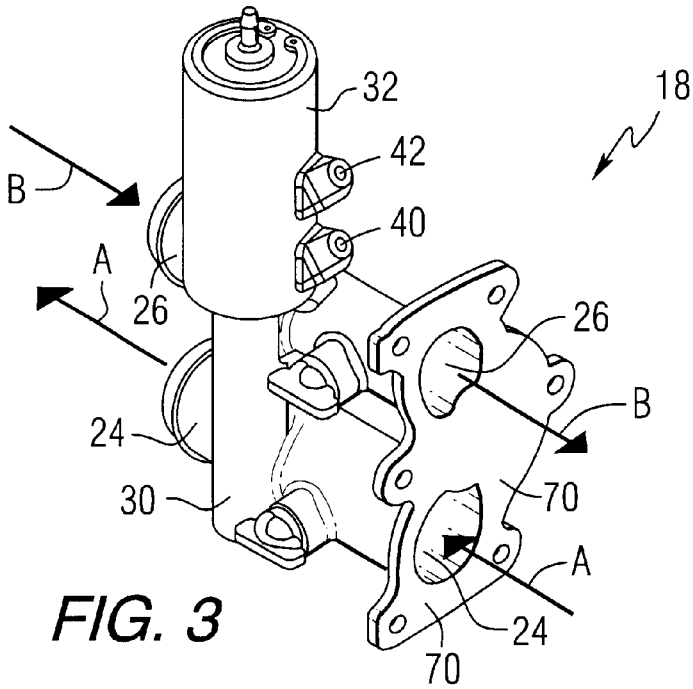

FIG. 3 is an isometric view of the second portion 18 of the housing structure showing the face 70 which is attachable to the first portion 16 by the bolts 20. Also shown in FIG. 3 are the inlet conduit 26 and the outlet conduit 24, with arrow A representing the direction of water pumped by the impeller 58 to the cooling passages of the engine and arrow B which shows the direction in which water is drawn from the body of water toward the cavity 56 described above in conjunction with FIG. 2. The drain conduit 30 extends in a generally vertical direction and houses the spool of the valve which will be described in greater detail below. Compartment 32 houses the piston that is pneumatically actuated to move the spool within the drain conduit 30. Ports 40 and 42 are identified in FIG. 3 and described above in conjunction with FIG. 1.

Figure 4:
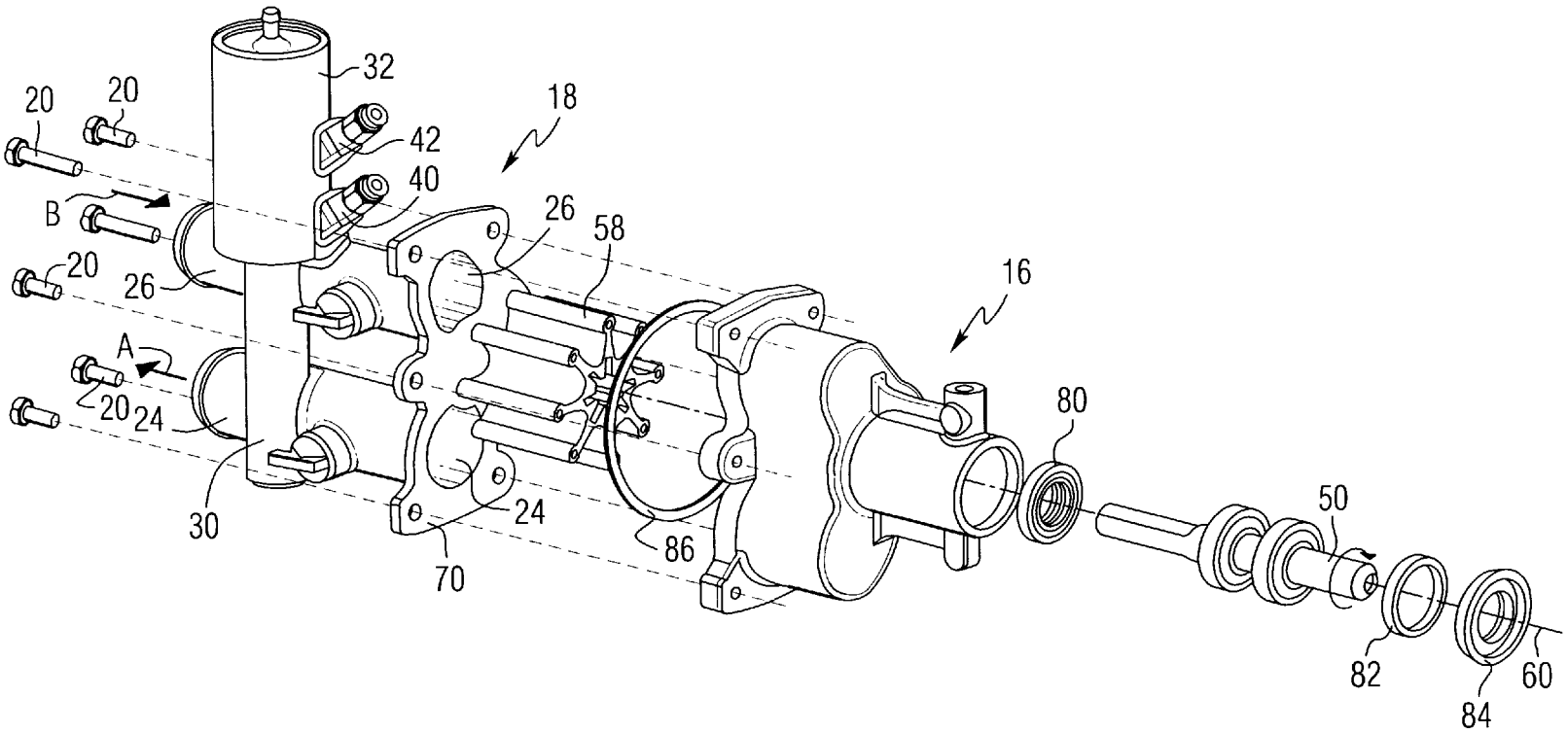
FIG. 4 is an exploded isometric view of the present invention including its integral components.

FIG. 4 is an exploded isometric view of the integral pump and drain apparatus 18 of the present invention. The impeller 58 is disposed within the cavity (not shown in FIG. 4) of the first portion 16 and connected to the shaft 50 which extends from the housing structure. A lip seal 80, a load ring 82, and a bilge seal retainer 84 are associated with the shaft 50 to support the shaft for rotation about axis 60 and prevent leakage out of the first portion 16 from the cavity. A rubber O-ring 86 is used to provide a seal around the cavity and between the opposing faces of the first and second portions when they are attached together. When the impeller 58 is caused to rotate within the cavity because of its attachment to the shaft 50, water is pumped from the body of water, as represented by arrow B into the cavity and then through the outlet conduit 24 as represented by arrow A.

Figure 5:
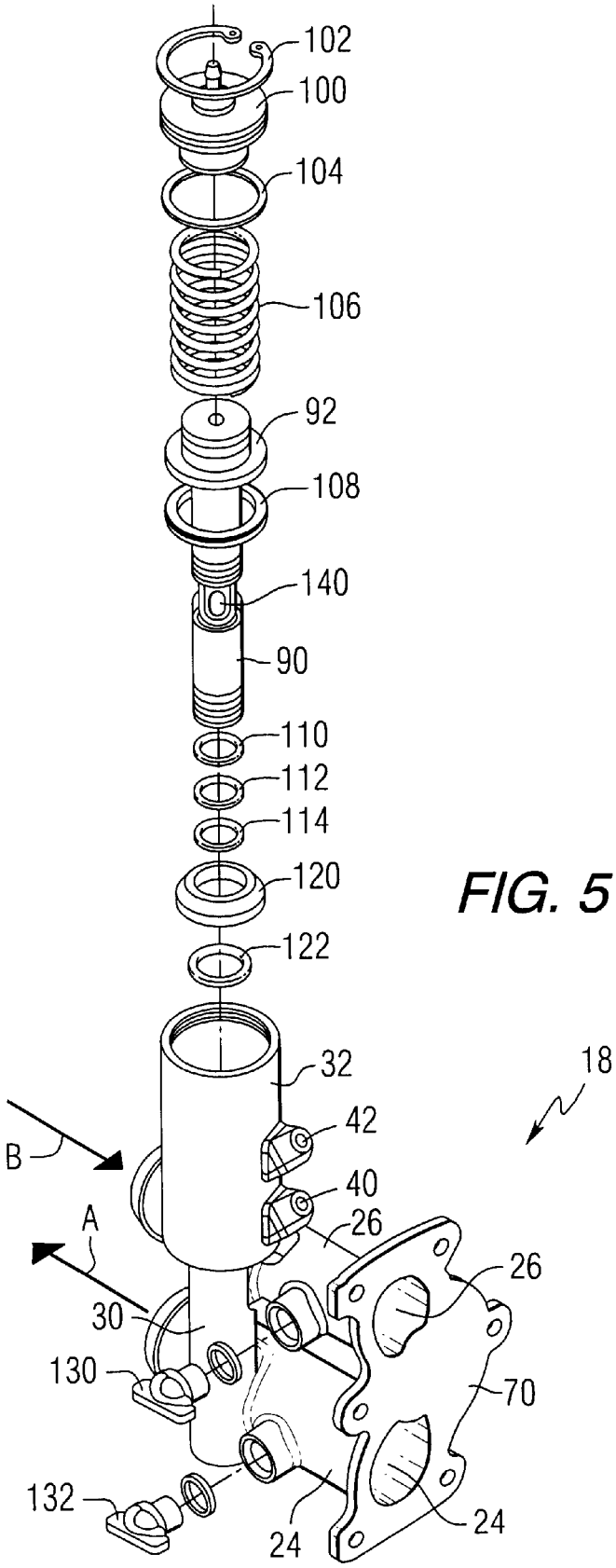
FIG. 5 is an exploded of the second portion of the present invention including its internal components.

FIG. 5 is an exploded view of the second portion 18 of the housing structure and the valve which comprises the spool 90 and a piston structure 92 which allows the spool to move upward and downward within the drain conduit 30 in response to pressure provided into the compartment 32.

In FIG. 5, a cover 100 is associated with a retaining ring 102 to close the upper open end of the compartment 32 and retain the piston 92 and spool 90 within the compartment. A rubber O-ring 104 seals bilge water from entering the upper end of the compartment 32 and a compression spring 106 urges the piston 92 and spool 90 in a downward direction within the compartment 32 and the drain conduit 30. A rubber U-cup seal 108 is associated with the piston 92 and rubber O-rings 110, 112, and 114 are disposed around various portions of the spool 90. A retainer 120 and another rubber O-ring 122 complete the assembly of the valve components that are disposed within the compartment 32 and the drain conduit 30. Also shown in FIG. 5 are two plugs, 130 and 132, that are manually removable from is openings formed in the outlet conduit 26 and inlet conduit 24, respectively. Each of the manually removable plugs is associated with an O-ring, as shown. These plugs are redundant water drains, which can be manually removed if the primary pneumatic system fails to operate.

Figure 7:
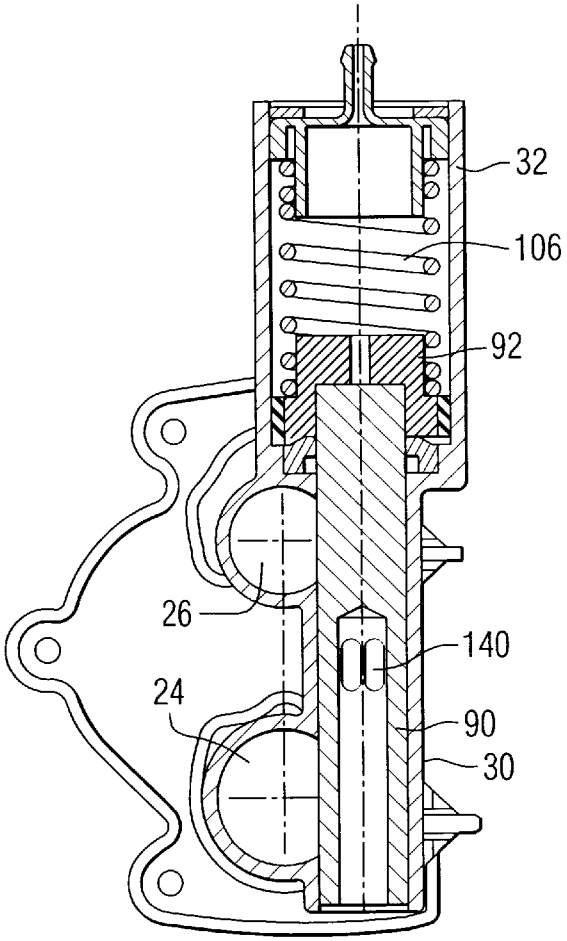
FIGS. 6 and 7 are section views of the drain valve of the present invention in its opened and closed positions, respectively.
Figure 6:
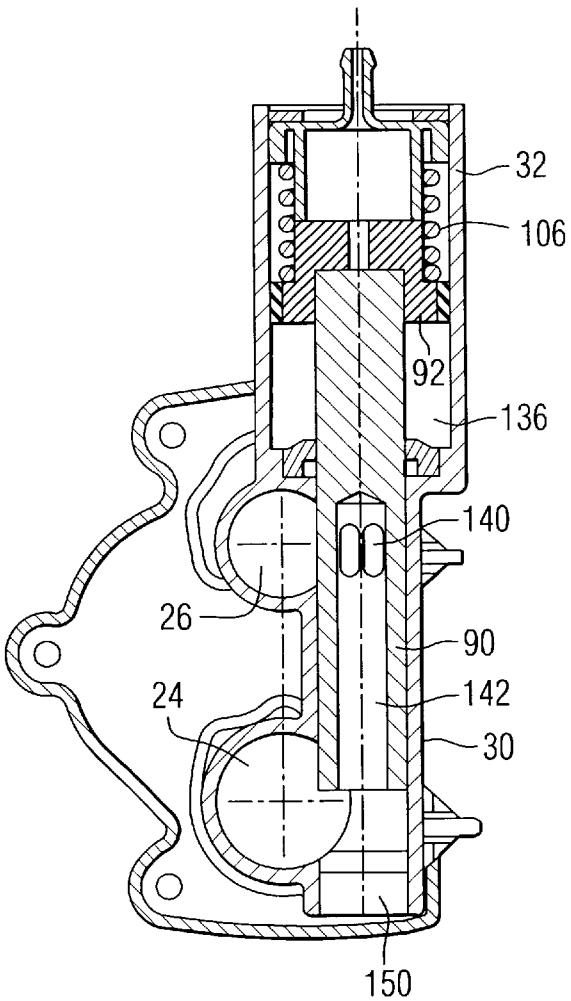

FIGS. 6 and 7 show the valve in opened and closed positions, respectively. When no pressure is provided through pneumatic port 40 (not shown in FIGS. 6 and 7), the piston 92 is in the position shown in FIG. 7 because of the downward force provided by the compression spring 106. The upper portion of the spool 90, above the radial openings 140, does not provide fluid communication between the inlet conduit 26 and either the outlet conduit 24 or the bilge of the boat below the engine. FIG. 7 represents the unactuated condition of the valve with the spring 106 causing the piston 92 to be in its downward position.

FIG. 6 shows the actuated position of the valve when air pressure is provided in chamber 136 of compartment 32 to force the piston 92 upward against the resistance of the spring 106. This places the radial openings 140 in fluid communication with the inlet conduit 26 as shown in FIG. 6. This allows water to flow from the inlet conduit 26, through the radial openings 140, and downward through the central cylindrical conduit 142 formed in the bottom portion of the spool 90. It can also be seen that when the spool 90 is in its upward position as shown in FIG. 6, water can flow directly from the outlet conduit 24 and through opening 150 at the bottom of the drain conduit 30. As a result, when the spool 90 is in its upward position as shown in FIG. 6, both the inlet conduit 26 and the outlet conduit 24 can drain through opening 150 and into the bilge of the boat. Spool 90 is moved to its opened position shown in FIG. 6 when air pressure is provided into chamber 136 through port 40 to force the piston 92 upward against the resistance of the spring 106.

With reference to FIG. 1, it can be seen that the present invention provides an integral pump and drain apparatus that is contained within a common housing structure. The common housing structure 12 is formed from a first portion 16 and a second portion 18 in order to facilitate the assembly of the internal components within the housing structure. The pump member, which comprises the impeller 58 and shaft 50 is disposed within the cavity 56 formed in the first portion 16 while the drain is provided in the second portion 18 of the housing structure. The unitary structure illustrated in FIG. 1 allows the marine propulsion system to be provided with a compact water pump and a drain system that is contained within a minimized space. In addition, it allows the integral pump and drain apparatus to have a drain which is remotely actuated by provided pressure to an inlet port 40. The water contained within the cooling passages of the engine and both the inlet conduit 26 and outlet conduit 24 to drain simultaneously through opening 150 when the spool 90 of the valve is in the upward position illustrated in FIG. 6. The spool portion of the valve has three different diameters, from top to bottom, and three different sizes of O-ring seals. The reason for this is to prevent damage to the O-rings during installation and/or use. If diameters were not stepped, the O-ring seals would interact with the sharp edges of the drain windows in the housing, and would be damaged in a short period of time. With the stepped diameters, the O-ring seals pass adjacent to the drain window edges but do not contact.

Although the present invention has been described with particular specificity and illustrated to show one particular preferred embodiment, it should be understood that other embodiments are also within its scope.

We claim:

1. A pump and drain apparatus for a marine propulsion system, comprising:

a housing structure;

a pumping member disposed within a cavity of said housing structure;

an inlet conduit formed within said housing structure and connected in fluid communication with said cavity;

an outlet conduit formed within said housing structure and connected in fluid communication with said cavity, actuation of said pumping member causing water to flow toward said cavity through said inlet conduit and away from said cavity through said outlet conduit;

a drain conduit formed within said housing structure and connectable in fluid communication with at least one of said inlet and outlet conduits; and a valve associated with said drain conduit for selectively opening or closing said drain conduit to drain water from at least one of said inlet and outlet conduits.

2. The apparatus of claim 1, wherein:

said pumping member comprises an impeller which is rotatable within said cavity for rotation about an axis for causing water to flow toward said cavity through said inlet conduit and away from said cavity through said outlet conduit.

3. The apparatus of claim 1, wherein:

said housing structure comprises a first portion and a second portion, said cavity being formed within said first portion, said drain conduit being formed within said second portion.

4. The apparatus of claim 1, wherein:

said valve is a pneumatically operated valve having a spool member which is movable within a portion of said drain conduit.

5. The apparatus of claim 4, wherein:

said spool member is movable to an opened position which connects said inlet and outlet conduits in fluid communication with said drain conduit to allow water to drain from at least one of said inlet and outlet conduits through said drain conduit.

6. The apparatus of claim 1, further comprising:

a shaft extending from said housing structure, said shaft being attached to said pumping member.

7. An integral pump and drain apparatus for a marine propulsion system, comprising:

a housing structure;

a rotatable pumping member disposed within a cavity of said housing structure for rotation about an axis;

an inlet conduit formed within said housing structure and connected in fluid communication with said cavity;

an outlet conduit formed within said housing structure and connected in fluid communication with said cavity, rotation of said pumping member about said axis causing water to flow toward said cavity through said inlet conduit and away from said cavity through said outlet conduit;

a drain conduit formed within said housing structure and connectable in fluid communication with at least one of said inlet and outlet conduits; and a valve associated with said drain conduit for selectively opening or closing said drain conduit.

8. The apparatus of claim 7, wherein:

a first portion of said housing structure and a second portion of said housing structure are fastened together to form said housing structure.

9. The apparatus of claim 8, wherein:

said cavity is formed within said first portion of said housing structure and said drain conduit is formed within said second portion of said housing structure.

10. The apparatus of claim 7, wherein:

said valve is a pneumatically actuated valve.

11. The apparatus of claim 7, wherein:

said valve comprises a spool member which is slidable within said drain conduit between an open position and a closed position.

12. The apparatus of claim 11, wherein:

said open position connects said inlet conduit in fluid communication with said outlet conduit.

13. The apparatus of claim 12, wherein:

said open position connects said inlet conduit and said outlet conduit in fluid communication with the atmosphere and allows water to drain into a bilge of a boat from both of said inlet and outlet conduits.

14. A pump and drain apparatus for a marine propulsion system, comprising:

a housing structure;

a pumping member disposed within a cavity of said housing structure;

an inlet conduit formed within said housing structure and connected in fluid communication with said cavity;

an outlet conduit formed within said housing structure and connected in fluid communication with said cavity, actuation of said pumping member causing water to flow toward said cavity through said inlet conduit and away from said cavity through said outlet conduit, said pumping member comprising an impeller which is rotatable within said cavity for rotation about an axis for causing water to flow toward said cavity through said inlet conduit and away from said cavity through said outlet conduit;

a drain conduit formed within said housing structure and connectable in fluid communication with at least one of said inlet and outlet conduits; and a valve associated with said drain conduit for selectively opening or closing said drain conduit to drain water from at least one of said inlet and outlet conduits.

15. The apparatus of claim 14, wherein:

said housing structure comprises a first portion and a second portion, said cavity being formed within said first portion, said drain conduit being formed within said second portion.

16. The apparatus of claim 15, wherein:

said valve is a pneumatically operated valve having a spool member which is movable within a portion of said drain conduit.

17. The apparatus of claim 16, wherein:

said spool member is movable to an opened position which connects said inlet and outlet conduits in fluid communication with said drain conduit to allow water to drain from at least one of said inlet and outlet conduits through said drain conduit.

18. The apparatus of claim 17, further comprising:

a shaft extending from said housing structure, said shaft being attached to said impeller of said pumping member.

* * * * *